US006513287B1

(12) United States Patent
Sorkin

(10) Patent No.: US 6,513,287 B1
(45) Date of Patent: Feb. 4, 2003

(54) APPARATUS FOR FORMING A DEAD-END ANCHORAGE OF A POST-TENSION SYSTEM

(76) Inventor: Felix L. Sorkin, 4115 Greenbriar Dr., P.O. Box 1503, Stafford, TX (US) 77477

( * ) Notice: Subject to any disclaimer, the term of this patent is extended or adjusted under 35 U.S.C. 154(b) by 99 days.

(21) Appl. No.: 09/655,292

(22) Filed: Sep. 5, 2000

(51) Int. Cl.[7] ..... E04C 5/08

(52) U.S. Cl. ..... 52/223.13; 52/223.8; 52/699; 24/122.6; 29/452; 249/43; 403/374.1; 403/371

(58) Field of Search ..... 52/223.13, 223.6, 52/223.14, 223.8, 745.21, 699; 24/122.6; 249/43, 217; 29/452, 453; 403/374.1, 373, 371, 368, 367

(56) References Cited

U.S. PATENT DOCUMENTS 3,590,474 A * 7/1971 Beghi ..... 29/452
3,858,991 A * 1/1975 Burtelson ..... 403/194
3,937,607 A * 2/1976 Rodormer ..... 425/111
3,956,797 A * 5/1976 Brandestini et al. ..... 24/126
4,719,658 A * 1/1988 Kriofske ..... 52/223 L
4,773,198 A * 9/1988 Reinhardt ..... 52/223 L
4,821,474 A * 4/1989 Rodriguez ..... 52/223 L
4,896,470 A * 1/1990 Sorkin ..... 52/230
4,918,887 A * 4/1990 Davis et al. ..... 52/223 L
5,024,032 A * 6/1991 Rodriguez ..... 52/223 L
5,072,558 A * 12/1991 Sorkin et al. ..... 52/230
5,347,777 A * 9/1994 Sudduth ..... 52/223.13
5,630,301 A * 5/1997 Sieg ..... 52/223.13
5,749,185 A * 5/1998 Sorkin ..... 52/223.13
5,755,065 A 5/1998 Sorkin
5,839,235 A * 11/1998 Sorkin ..... 52/223.13
5,897,102 A * 4/1999 Sorkin ..... 254/29 A
6,017,165 A * 1/2000 Sorkin ..... 403/374.1
6,023,894 A * 2/2000 Sorkin ..... 52/223.13
6,027,278 A * 2/2000 Sorkin ..... 403/374.1
6,234,709 B1 * 5/2000 Sorkin ..... 403/374.1

OTHER PUBLICATIONS

Photograph of Dead End Anchorage forming Device, showing the dead end anchorage forming device of the prior art, as shown in the "Prior Art" illustrations of the original specification in Figures 1 & 2.

* cited by examiner

*Primary Examiner*—Yvonne M. Horton
(74) *Attorney, Agent, or Firm*—Harrison & Egbert

(57) ABSTRACT

A method and apparatus for forming an anchorage of a post-tension system in which a tendon is positioned within a cavity of an anchor such that an end of the tendon extends outwardly of the cavity, a plurality of wedges are mechanically inserted within the cavity between the tendon and a wall of the cavity, and pressure is applied to an end of the tendon such that the tendon and the wedges are in interference-fit relationship with the cavity. A compression mechanism is used having a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

15 Claims, 4 Drawing Sheets

APPARATUS FOR FORMING A DEAD-END ANCHORAGE OF A POST-TENSION SYSTEM

TECHNICAL FIELD

The present invention relates to dead-end anchorages. More particularly, the present invention relates to methods and apparatus which are used so as to mechanically secure the end of a tendon within an interior cavity of an anchor. The present invention also relates to dead-end anchorage forming mechanisms in which a compressive force is applied to the end of the tendon.

BACKGROUND ART

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live end" anchor, and the opposite end is known as the "dead-end" anchor. The "live end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult since the tendon can have a considerable length and since the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

FIG. 1 shows one such type of compression system for the forming of a dead-end anchor. In FIG. 1, it can be seen that a fixture 10 is provided on a base 12 having a channel 14 suitable for receiving a tendon 16 in a desired position. An anchor 18 is connected to the tendon 16 and resides against a wall 20 of the fixture 10. In this arrangement, the wide end of the cavity of the anchor 18 faces outwardly. A compression mechanism 22 has a plunger 24 at one end. The compression mechanism 22 includes a hydraulic or pneumatic system 26 for the purpose of applying strong pressures to the plunger 24. The plunger 24 includes an indentation 28 at the end 30 so as to allow the end of the tendon 16 to be inserted therein. When suitable hydraulic pressure is applied to the plunger 24, the plunger 24 will move toward the anchor 18 so as to apply compressive forces onto the end of the tendon 16 for the purpose of establishing a strong interference-fit relationship between the tendon, the wedges and the wall of the cavity of the anchor 18.

FIG. 2 is a more detailed view of the prior art system of FIG. 1 showing the formation of the dead-end anchorage. In particular, in FIG. 2, there is shown the anchor 18 as having a steel anchor body 32 with a polymeric encapsulation 34 extending therearound. The anchor body 32 includes an interior cavity 36 which tapers inwardly from end 38 toward end 40. Wedges 42 are positioned in the cavity 36 between the exterior of the tendon 16 and the inner wall 44 of the cavity 36. The plunger 24 is shown as having indentation 28 at the end 30. The plunger 24 will move toward the end 38 of the anchor 18 so as to force the tendon 16 and the wedges 42 into the cavity 36.

In the normal process of using the system of FIGS. 1 and 2, the anchor 18 is initially installed within its desired position in the fixture 12 so that a surface of the anchor 18 abuts the wall 20 of the fixture 10. The end of the tendon 16 is positioned within the cavity 36 of the anchor 18 so as to have its end 46 extending outwardly of the end 38 of the anchor 18. The wedges 42 are then installed, by hand, into the cavity 36 in the gap between the wall 44 of the anchor 18 and the exterior surface of the tendon 16. As shown in FIG. 2, these wedges 42 can only be installed by hand a small distance into the cavity 36. The plunger 24 is then activated so that the end 46 of the tendon 16 will enter the indentation 28 of the plunger 24. The strong forces imparted by the compression mechanism 26 force the tendon 16 and the wedges 42 into the cavity 36. The plunger 24 is then retracted so that the anchor 18 can be removed from the fixture 10.

There are several problems with the system shown in FIGS. 1 and 2. First, the wedges 42 must be positioned by hand. In certain circumstances, the wedges 42 may be positioned unevenly. In other circumstances, the use of such strong hydraulic mechanisms can cause injury if the user's hands are not removed from the area between the anchor 18 and the end 28 of the plunger 24. The indentation 28 has a relatively large size compared to the end 46 of the tendon 16. This wide opening is required in case a burr or other deformation has occurred in the end 46 of the tendon 16. Since the indentation 28 is relatively large, the end 46 of the tendon 16 can have a tendency to buckle when the forces are applied by the plunger 24. Furthermore, the mechanism shown in FIGS. 1 and 2 makes it very difficult to control the distance between the end of the wedges 42 and the end 46 of the strand 16.

It is an object of the present invention to provide a method and apparatus for forming a dead-end anchorage which installs the tendon in the anchor by compression forces.

It is another object of the present invention to provide a method and apparatus which eliminates the hand positioning of wedges during such compression forming.

It is another object of the present invention to provide a method and apparatus which eliminates any buckling of the end of the strand during compression fitting.

It is still another object of the present invention to provide a method and apparatus which properly meters the distance between the end of the strand and the end of the wedges.

It is still a further object of the present invention to provide a method and apparatus for forming a dead-end anchorage which is safe, easy to use, and relatively inexpensive.

These and other objects and advantages of the present invention will become apparent from a reading of the attached specification and appended claims.

SUMMARY OF THE INVENTION

The present invention is a method for forming an anchorage of a post-tension system comprising the steps of: (1) positioning a tendon within a cavity of an anchor body such that an end of the tendon extends outwardly of the cavity; (2) mechanically inserting wedges within the cavity between the tendon and a wall of the cavity; and (3) applying pressure onto the end of the tendon such that the tendon and the wedges are in interference-fit relationship within the cavity.

In the method of the present invention, a compression mechanism is used which has a cylindrical member and a plunger extending in a channel interior of the cylindrical member. In the method of the present invention, the wedges are attached to the cylindrical member, and then the cylindrical member is moved toward the cavity such that the wedges enter a space between the tendon and the wall of the cavity. Specifically, in a preferred embodiment of the present invention, the wedges are magnetically attached to an end of the cylindrical member. The cylindrical member is moved toward the cavity such that the end of the tendon resides within the interior space of the cylindrical member. The plunger is moved through the interior channel toward the end of the tendon such that the end of the plunger applies pressure onto the end of the tendon within the space. The anchor can be affixed within a fixture such that a wide end of the cavity faces the wedges. In the method of the present invention, the cylindrical member and the plunger can be retracted from the end of the tendon after the proper pressure is applied to the end of the tendon.

The present invention is also an apparatus for forming the anchorage of a post-tension system comprising a housing, a piston member positioned within the housing and movable relative to the housing, a cylindrical member connected to the piston member and having a channel formed therein, and a plunger axially movable within the channel in the cylindrical member. A frame receives the housing therein and has a portion extending outwardly of an end of the cylindrical member. A fixture is provided which is suitable for receiving an anchor therein. A plurality of wedges are releasably secured to an end of the cylindrical member. The cylindrical member is resiliently mounted within the piston member. The cylindrical member has an end extending outwardly of an end of the piston member. The plunger is connected to the piston so as to move through the channel within the cylindrical member when a resistive force is applied to an end of the cylindrical member. The anchor is positioned so as to have a wide end of a cavity facing the cylindrical member. The tendon extends through the cavity so as to have an end extending outwardly thereof. The channel of the cylindrical member has a size suitable for receiving the end of the tendon therein.

DETAILED DESCRIPTION OF THE INVENTION

Figure 3:
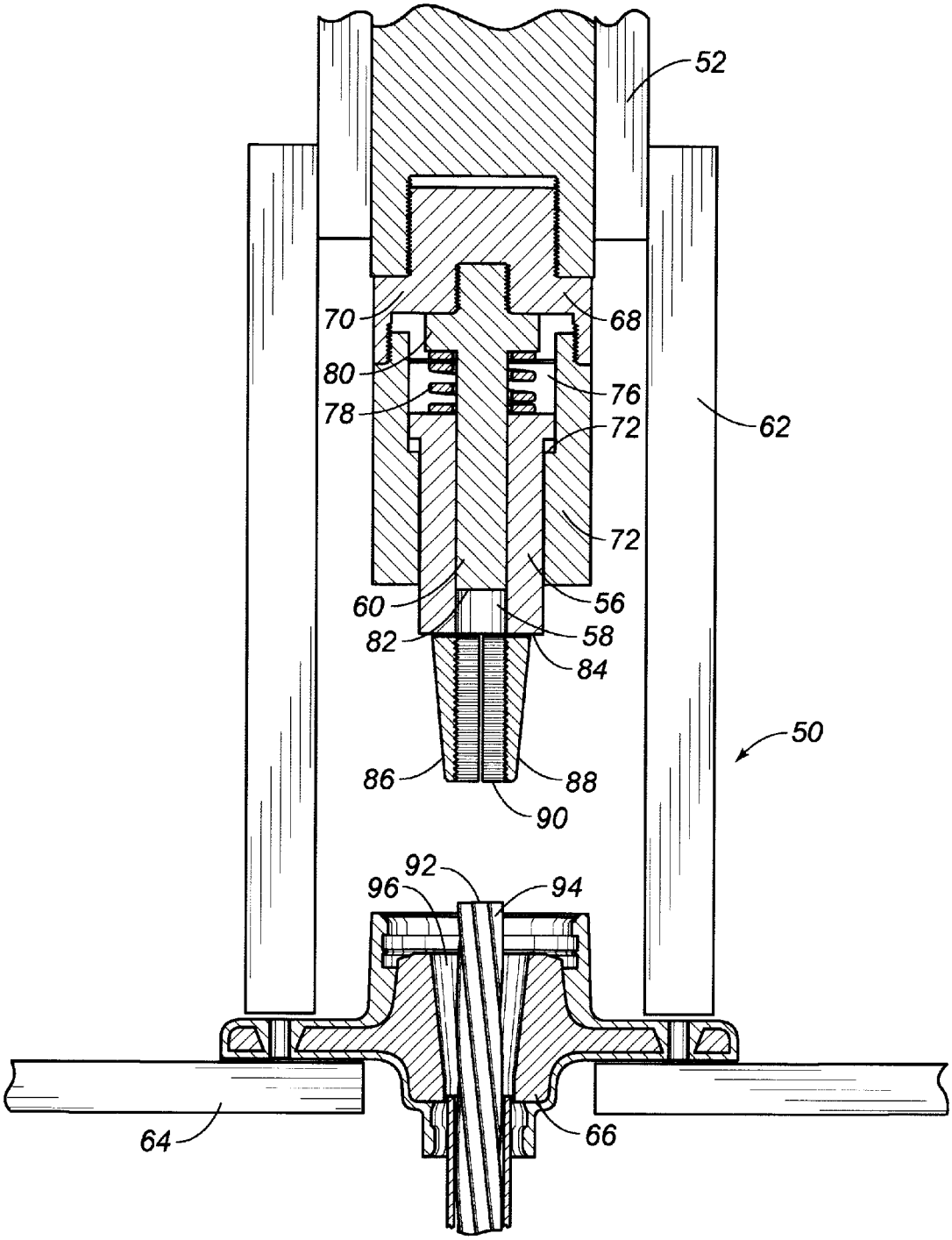
FIG. 3 is a cross-sectional view showing an initial stage of the method and apparatus of the present invention.

Referring to FIG. 3, there is shown the apparatus 50 for the formation of a dead-end anchorage. The apparatus 50 includes a housing 52, a piston member 54 positioned within the housing 52, a cylindrical member 56 connected to the piston member 54 and having an interior channel 58 therein and a plunger 60 movable within the channel 58 of the cylindrical member 56. A frame 62 can be connected to the housing 52 and extend outwardly therefrom. A fixture 64 is provided so as to allow the anchor 66 to be positioned in a proper position relative to the apparatus 50.

Figure 1:
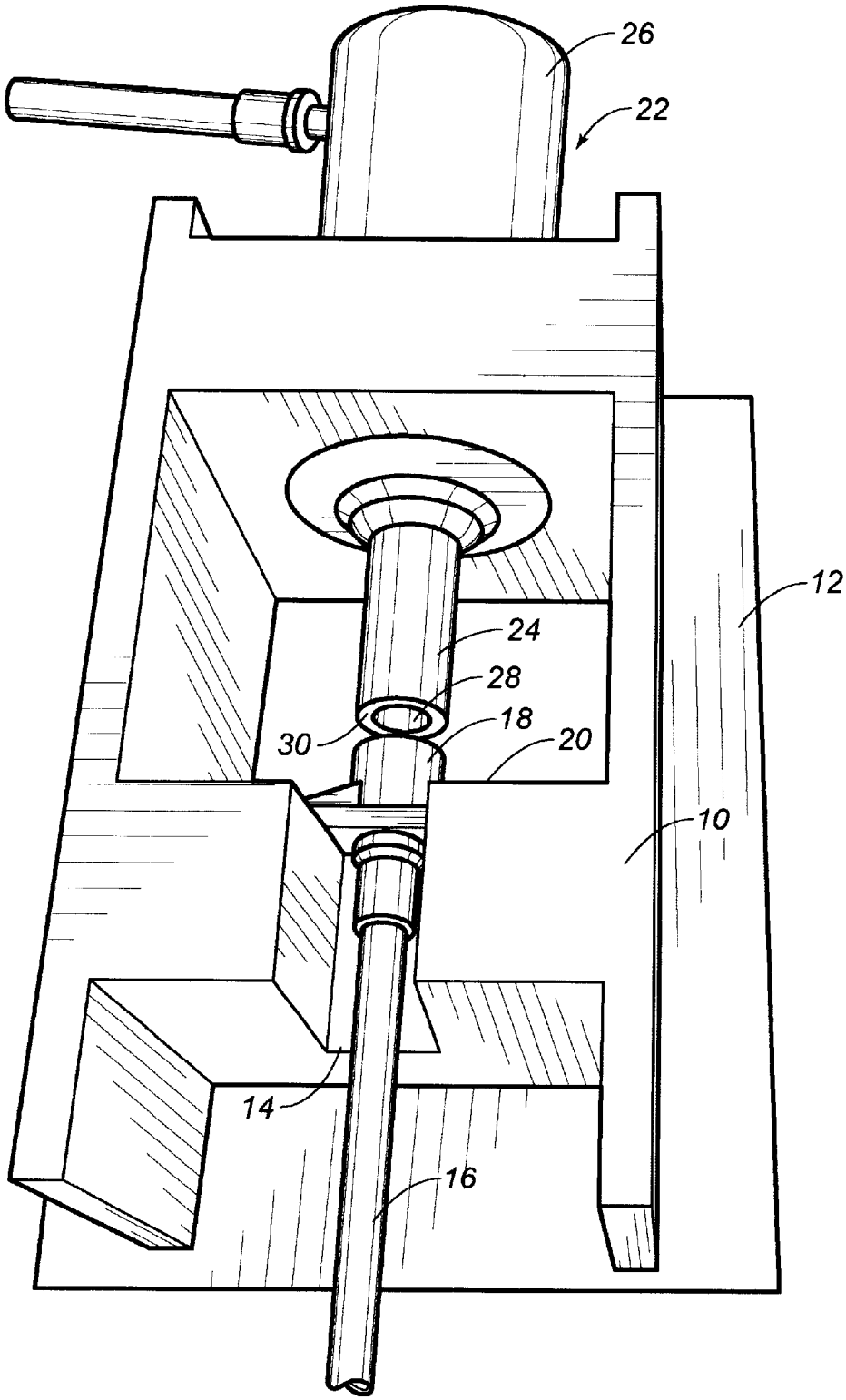
FIG. 1 Prior Art
FIG. 1 is a perspective view of a prior art compression system for forming a dead-end anchorage.

In the present invention, the housing 52 can be of a similar type of housing as that shown by the compression mechanism 22 of the prior art system of FIG. 1. The housing 52 can be part of a hydraulic or pneumatic system whereby a suitable force can be applied such that the piston member 54 is movable relative to the housing 52. Suitable hydraulic or pneumatic connections can be connected to the housing 52 so as to properly impart the desired motion to the piston member 54. The piston member 54 is axially movable within the housing 52. A holder member 68 is connected to the piston member 54. The holder member includes a connector 70 affixed to the end of the piston member 54 and a support section 72 connected to the connector 70. The cylindrical member 56 is slidably disposed within the interior of the support section 72. The support section 72 will have a generally tubular configuration. A shoulder 74 is formed on the interior of the support section 72 so as to provide a stop to the slidable movement of the cylindrical member 56.

The cylindrical member 56 is shown as received within the interior area 76 of the support section 72. A spring 78 is connected to an end of the cylindrical member 56 such that the cylindrical member 56 is resiliently mounted within the interior of the support section 72. The cylindrical member 56 includes a channel 58 extending axially therethrough. The channel 58 is a space in which the plunger 60 can move relative to the cylindrical member 56. In normal use, and without contact onto another surface, the cylindrical member 56 will move with the movement of the piston member 54.

The plunger 60 has one end connected to the connector 70 associated with the piston member 54. The plunger 60 has a widened annular portion 80 which resides against a surface of the holder member section 68. The annular portion 80 also provides an abutment surface for an end of the spring 78. Spring 78 provides a resilient connection between the cylindrical member 56 and the plunger 60. The plunger 60 has an end 82 residing within the channel 58 inwardly of the end 84 of the cylindrical member 56.

As can be seen in FIG. 3, wedges 86 and 88 are connected to the end 84 of the cylindrical member 56. In the preferred embodiment of the present invention, the end 84 of the cylindrical member 56 is suitably magnetic so that the wedges 86 and 88 can be magnetically secured thereto. In alternative forms of the present invention, the end 84 of the cylindrical member 56 can have a suitable connector so that the wedges 86 and 88 can be mechanically secured thereto. As can be seen, the wedges 86 and 88 will define an interior passage 90 to which the end 92 of the tendon 94 will pass. The wedges 86 and 88 are positioned so as to face the cavity 96 of the anchor 66.

As can be seen in FIG. 3, the present invention allows the wedges 86 and 88 to be simply placed onto the end 84 of the cylindrical member 56. The magnetic attraction between the end 84 of the cylindrical member 56 will maintain the wedges 86 and 88 in their desired position. It is not necessary for the worker to manually install the wedges 86 and 88 into the cavity 96. The present invention improves safety because the wedges 86 and 88 do not have to be installed in a confined space between the hydraulically-actuated plunger and the anchor.

Figure 2:
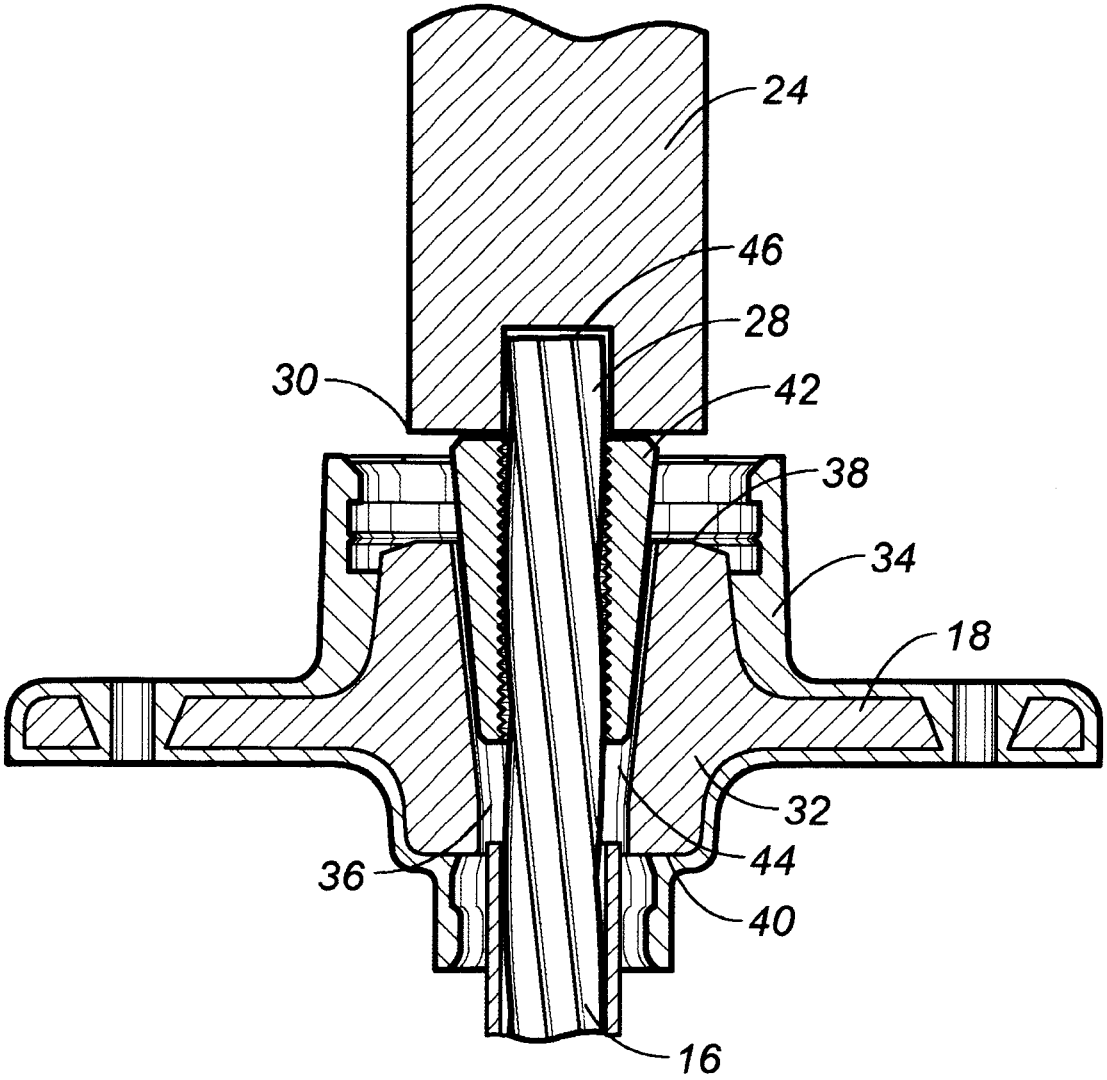
FIG. 2 Prior Art
FIG. 2 is a cross-sectional view of the prior art mechanism of FIG. 1.
Figure 4:
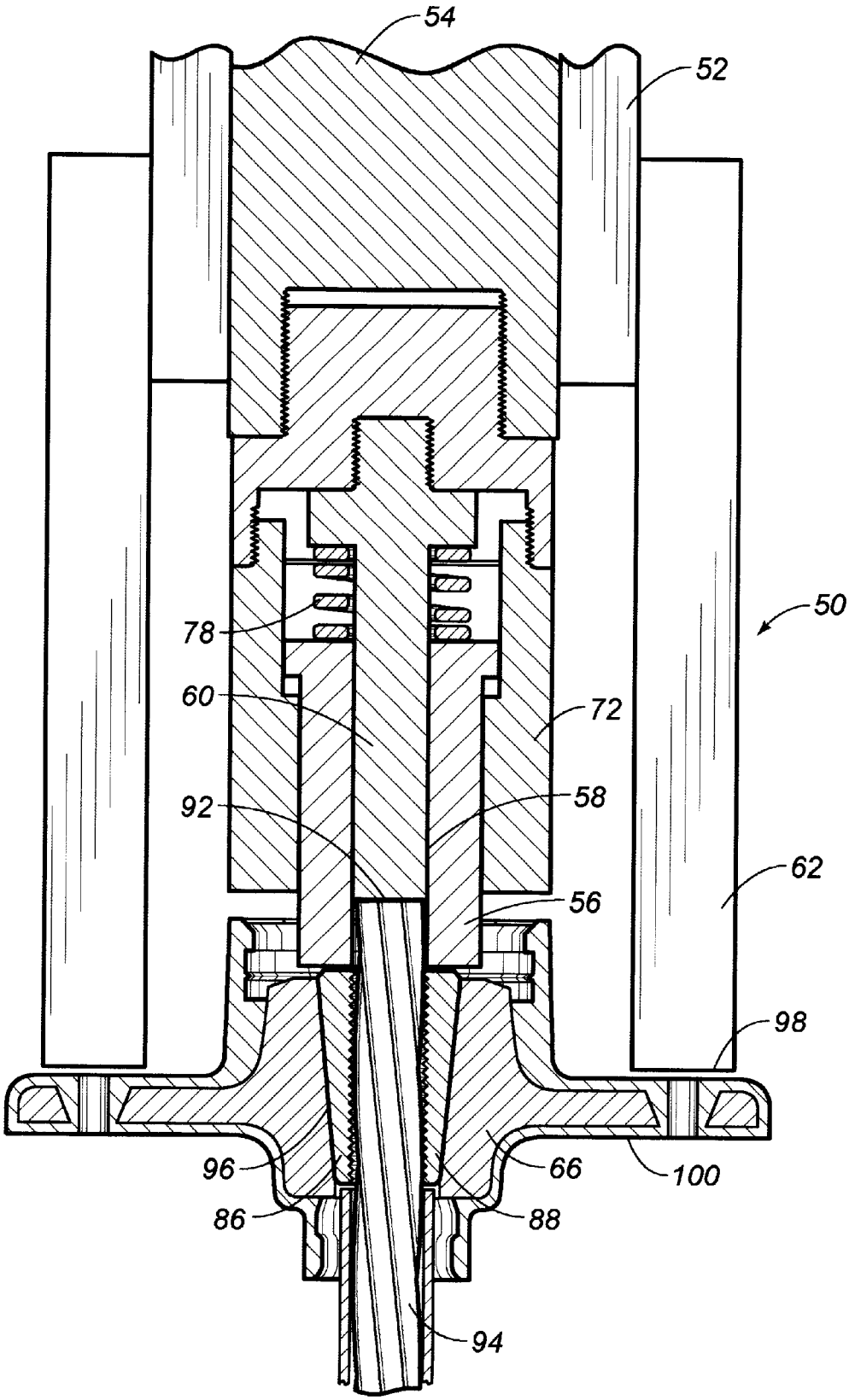
FIG. 4 is a cross-sectional view showing a later stage of the method and apparatus of the present invention.

FIG. 4 shows a later stage of the present invention. As shown in FIG. 4, the piston member 54 has been suitably actuated by hydraulic mechanisms (such as that shown in the prior art systems of FIGS. 1 and 2). This will cause the piston member 54 to move relative to the housing 52. As a result, the support section 72 is moved toward the anchor 66. In particular, it can be seen that the wedges 86 and 88 have been fully inserted within the wedge cavity 96 of the anchor 66. During this installation process, the end 92 of the tendon 94 enters the channel 58 with cylindrical member 56. The continued pressurized movement of the piston member 54 will cause the plunger 60 to exert strong pressures onto the end 92 of tendon 94. This will create a strong interference-fit relationship between the tendon 94, the wedges 86 and 88 and the wall of the wedge cavity 96. The movement of the wedges 86 and 88 will be suitably limited by the resilient mounting of the cylindrical member 56 within the support section 72. The spring 78 will resist the retracting movement of the cylindrical member 56 to a limited extent. When the force of the spring 78 is overcome, then the wedges 86 and 88 will reside in their desired position within the cavity 96. In this circumstance, the plunger 60 can continue to move within the channel 58 so as to effect the connection of the tendon 94 within the dead-end anchor 66.

After installation, the piston member 54 can be suitably retracted so that the end 92 of the tendon 94 moves outwardly of the channel 58 within the cylindrical member 56. In case the end 92 of the tendon 94 is hung up in the channel 58, the frame 62 includes an abutment surface 98 contacting the flange portion 100 of the anchor 66. This will resist the movement of the anchor 66 along with the retracting piston member 54. The anchor 66 can then be removed from its fixture 64 with its dead-end anchorage properly installed.

In the present invention, the possibility of the buckling of the end 92 of the tendon 94 is presented by the small clearance between the wall of the channel 58 and the exterior surface of the end 92 of tendon 94. The relationship between the plunger 60 and the cylindrical member 56 assures a proper metering of the distance in which the ends 92 of tendon 94 extends outwardly of the end of the wedges 86 and 88. The direct application of pressure only onto the end 92 of the tendon 94 provides the ultimate connection method. Experimentation has shown that the strongest connection technique is when the tendon 94 expands within the cavity 96 so as to force the wedges 86 and 88 outwardly into interference-fit relationship with the wall of the cavity 96. This is superior to the prior art in which pressure is applied to both the wedges and to the tendon, simultaneously, for installation purposes.

The foregoing disclosure and description of the invention is illustrative and explanatory thereof. Various changes in the details of the illustrated construction or in the steps of the described method may be made within the scope of the appended claims without departing from the true spirit of the invention. The present invention should only be limited by the following claims and their legal equivalents.

I claim:

1. An apparatus for forming an anchorage of a post-tension system comprising:

a housing;

a piston member positioned within said housing, said piston member being movable relative to said housing;

a cylindrical member connected to said piston member, said cylindrical member defining a space therewithin; and a plunger axially movable within said space in said cylindrical member.

2. The apparatus of claim 1, further comprising:

a frame receiving said housing therein and having a portion extending outwardly beyond an end of said cylindrical member; and a fixture having an area suitable for receiving an anchor therein, said portion of said portion of said frame having a surface suitable for abutting a surface of an anchor.

3. The apparatus of claim 1, further comprising:

a plurality of wedges releasably affixed to an end of said cylindrical member.

4. The apparatus of claim 3, said plurality of wedges being magnetically affixed to said end of said cylindrical member.

5. The apparatus of claim 1, said cylindrical member being resiliently mounted within said piston member, said cylindrical member having an end extending outwardly of an end of said piston member.

6. The apparatus of claim 1, said plunger connected to said piston so as to move through said space within said cylindrical member when a resistive force is applied to an end of said cylindrical member.

7. The apparatus of claim 1, further comprising:

an anchor positioned so as to have a wide end of a cavity thereon facing said cylindrical member; and a tendon extending through said cavity so as to have an end extending outwardly thereof, said space of said cylindrical member having a size suitable for receiving said end of said tendon therein.

8. A method for forming an anchorage of a post-tension system comprising:

positioning a tendon within a cavity of an anchor such that an end of the tendon extends outwardly of said cavity;

mechanically inserting wedges within said cavity between said tendon and a wall of said cavity;

applying pressure onto said end of said tendon such that said tendon and said wedges are in interference-fit relationship within said cavity; and forming a compression mechanism having a cylindrical member and a plunger interior of said cylindrical member.

9. The method of claim 8, said step of mechanically inserting comprising:

attaching said wedges to said cylindrical member; and moving said cylindrical member toward said cavity such that said wedges enter a space between said tendon and said wall of said cavity.

10. The method of claim 9, said step of attaching comprising:

magnetically affixing a wide end of said wedges onto an end of said cylindrical member.

11. The method of claim 8, said cylindrical member defining an interior space therewithin, said plunger being axially movable through said interior space.

12. The method of claim 11, said step of applying pressure comprising:

moving said cylindrical member toward said cavity such that said end of said tendon resides within said interior space of said cylindrical member; and moving said plunger toward said end of said tendon such that an end of said plunger applies pressure onto said end of said tendon within said space.

13. The method of claim 8, further comprising:

affixing said anchor within a fixture such that a wide end of said-cavity faces said wedges.

14. The method of claim 12, further comprising:

retracting said cylindrical member and said plunger from said end of said tendon after pressure is applied to said end of said tendon.

15. The method of claim 14, further comprising:

applying pressure against a flange of said anchor during said step of retracting.

* * * * *